US006776519B2

(12) United States Patent
Eleuterio et al.

(10) Patent No.: US 6,776,519 B2
(45) Date of Patent: Aug. 17, 2004

(54) MYSTERIOUS ROTATING BEZEL

(75) Inventors: Luciano Eleuterio, Corgémont (CH); Sébastien Hostettler, Sonceboz (CH); Domenico Leo, Bévilard (CH)

(73) Assignee: The Swatch Group Management Services AG, Biel (CH)

( * ) Notice: Subject to any disclaimer, the term of this patent is extended or adjusted under 35 U.S.C. 154(b) by 0 days.

(21) Appl. No.: 10/383,681

(22) Filed: Mar. 10, 2003

(65) Prior Publication Data

US 2003/0169645 A1 Sep. 11, 2003

(30) Foreign Application Priority Data

Mar. 11, 2002 (CH) ..... 0413/02

(51) Int. Cl.[7] ..... G04B 37/00; G04B 39/00
(52) U.S. Cl. ..... 368/295; 368/306; 368/308
(58) Field of Search ..... 368/294–296, 368/306–308

(56) References Cited

U.S. PATENT DOCUMENTS 4,035,617 A * 7/1977 Banner ..... 235/88 N
5,490,123 A * 2/1996 Biver ..... 368/295
5,541,895 A * 7/1996 Nussbaum ..... 368/295
6,310,835 B1 * 10/2001 Mantoan et al. ..... 368/69
6,565,253 B1 * 5/2003 Yang ..... 368/294

FOREIGN PATENT DOCUMENTS

CH 436468 A1 * 7/1991 ..... 368/294
CH 573386 A1 * 12/1993 ..... 368/295

OTHER PUBLICATIONS

Patent Abstracts of Japan, vol. 1996, No. 8, Aug. 30, 1996 & JP 08 110382 (Yamamoto Seisakusho KK), Apr. 30, 1996.

* cited by examiner

*Primary Examiner*—Randy Gibson
*Assistant Examiner*—Michael L. Lindinger
(74) *Attorney, Agent, or Firm*—Sughrue Mion, PLLC

(57) ABSTRACT

The bezel (2) allows the same reading direction to be kept for the indications (20) carried by a ring (4) able to rotate freely on a base (6) to which it is affixed to bring a selected indication (20) opposite a determined marking of the base (6) or of a dial (3). The indications (20) are marked on the outer surface of studs (10) each kept free in rotation about their rotational axis (10*a*) in a housing (30) provided through the thickness of the ring (4) and opening onto the base (6). Each stud (10) includes in its lower part (9*b*) at least two stems (11, 13, 15) of different dimensions, offset by the same distance from the rotational axis (10*a*) of the studs (10), and having an angular offset of less than 180°, each stem (11, 13, 15) being guided during rotation of the bezel (2) by a circular groove (12, 14, 16) formed in the base (6) and having a cross-section adapted to the dimensions of each stem (11, 13, 15), a radius equal to that of the circle (18) described by the rotational axis of the studs, the centres (12*a*, 14*a*, 16*a*) of each groove (12, 14, 16) having, with respect to the centre of the dial, exactly the same arrangement as the stems (11, 13, 15) with respect to the rotational axis (10*a*) of the studs (10).

12 Claims, 3 Drawing Sheets

Fig.3 bis

MYSTERIOUS ROTATING BEZEL

BACKGROUND OF THE INVENTION

The present invention concerns a rotating bezel particularly for a timepiece such as a wristwatch, a clock or an alarm clock with a mechanical or electronic movement. This rotating bezel can be termed "mysterious" in that the orientation of the indications carried by the bezel, such as alphanumerical signs, always remain the same, i.e. these indications are always legible in the same direction as the indications marked on the dial whatever the rotational angle imparted to the bezel.

In all the currently known wristwatches with a rotating bezel, for example diving watches, the indications are marked on the bezel in radial directions such that it is possible to read them properly only when an indication is brought to the 12 o'clock position, with the obvious risk of the figures 6 and 9 being confused at the moment of selection. A watch of this type, with the figures from 1 to 12 being the indications carried by the bezel, is shown in FIG. 1.

However, there exists a Japanese Patent No. JP 2599334, which attempts to provide a solution to the aforementioned problem. In the proposed device, the principle of which is shown in FIG. 2, the indications are carried by studs that are rotationally mobile in housings of the bezel, each stud having at its base a stem that is offset with respect to the axis of the stud. The stem is engaged in a circular groove of the same diameter as the circle described by the rotational axis of the studs, but whose centre is offset with respect to the centre of the dial by a distance equal to the distance between the rotational axis of each stud and the stem. For a rotation less than 180°, the indications maintain a vertical reading position. The 180° position (at 6 o'clock here) corresponds to an unstable position in which either a blockage can occur, which was observed by the inventors of the present invention, or rotation can continue beyond 180 ° still maintaining the vertical position, but also with the risk of creating a tipping movement causing the stems of two successive studs to come closer together as shown in FIG. 2, a the 5 o'clock position. In order to overcome this drawback, the author proposes placing a washer at the base of the studs, through which the stems of the studs pass at regular intervals, said washer being driven in rotation at the same time as the bezel. This solution, which requires the use of an additional part, theoretically allows the desired object to be attained but, because of the contact surface of the washer on the edges of the groove, has the major drawback of considerably increasing friction, to such a point that no product known to the Applicant includes such a device.

SUMMARY OF THE INVENTION

The present invention provides a different solution, allowing the drawbacks of the aforecited prior art to be overcome by providing a rotating bezel having a reduced number of parts to be assembled, and allowing the bezel to rotate freely, while still keeping the indications borne by the latter legible in the same direction.

The invention therefore concerns a rotating bezel comprising a ring able to rotate freely on a base in order to bring a selected indication opposite a determined mark of the base or a dial located at the centre of the bezel. The indications, alphanumerical characters, pictograms or other elements, are not directly marked on the ring but on the outer surface of studs that are each able to rotate freely about their axis of revolution in a housing arranged through the thickness of the ring and opening onto the base. Each stud includes on its lower part at least two stems of different dimensions, offset by the same distance from the axis of revolution of the studs, and having an angular offset less than 180°. When the bezel is driven in rotation, each stem is guided by a circular groove formed in the base and having a cross-section adapted to the dimensions of each stem, a radius equal to that of-the circle described by the axis of revolution of the studs, the centres of each groove having, with respect to the centre of the dial, exactly the same arrangement as the stems with respect to the axis of revolution of the studs.

When the studs include only two stems, the stems must not be aligned on the same diameter, otherwise there would still be the risk, as in the aforecited prior art, of an unstable position in which the rotation of the bezel could be blocked, or beyond which a reversion of the rotational direction of the studs in their housing could occur. With the proposed construction, the grooves necessarily intersect and, in a way, create switches. According to the invention, in order for each stem to recognise the direction to take in a switch, the stems of each stud and correlatively the cross-sections of the grooves, have different dimensions, either in length, or in diameter, or both in length and diameter. Although each stud can only include two stems, tests have shown that the most satisfactory result is obtained with studs including three studs offset angularly by 120° and differentiated both by their length and their diameter.

BRIEF DESCRIPTION OF THE DRAWINGS

Other features and advantages of the invention will appear during the following description, given solely by way of example, and made with reference to the annexed drawings, in which:

FIGS. 3 and 3*b* is show top views of a wristwatch with a rotating bezel according to the invention in two different positions;

DETAILED DESCRIPTION OF THE INVENTION

Figure 1:
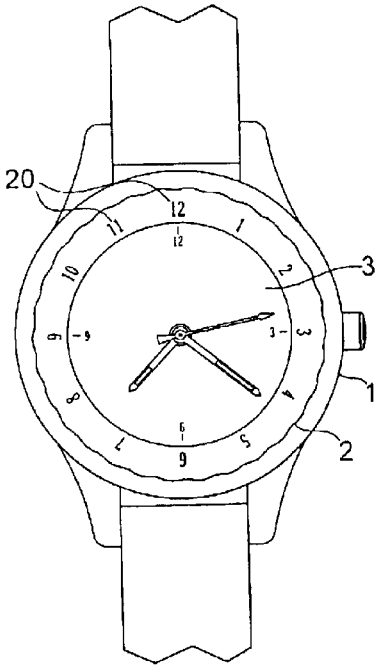
Fig.1 (PRIOR ART)
FIG. 1 shows a top view of a wristwatch having a rotating bezel according to the prior art.
Figure 2:
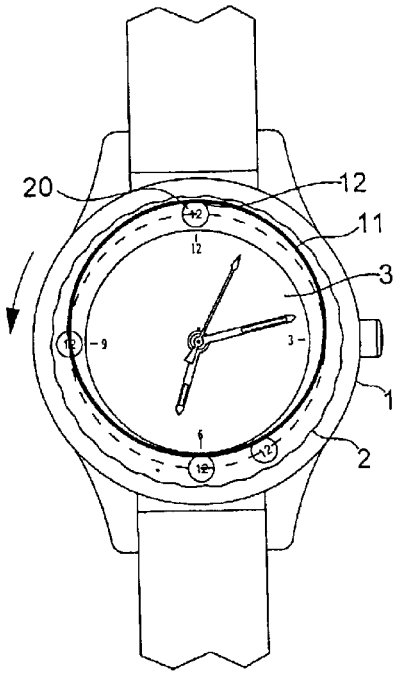
Fig.2 (PRIOR ART)
FIG. 2 shows the mechanism of another wristwatch with a rotating bezel according to the prior art.

FIGS. 1 and 2 correspond to the prior art explained in the preamble and will thus not be described further.

Figure 3:
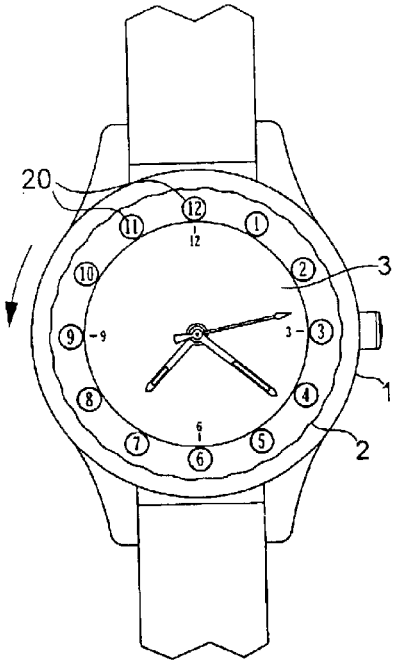
Figure 3:
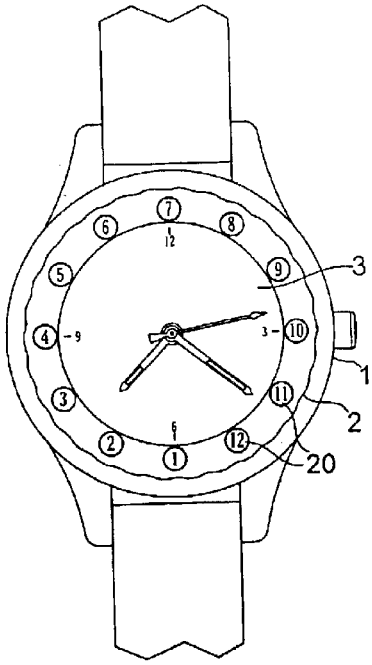

FIG. 3 shows, by way of example a wristwatch wherein the top part of the middle part 1 is provided with a rotating bezel 2 bearing indications 20 represented by the figures 1 to 12 which are, as can be seen, all legible in the same direction, namely in the same direction as the time indications carried by a dial 3 for an analogue time display, closed by a crystal 5. FIG. 3*b* is shows this same wristwatch after bezel 2 has been rotated in the direction indicated by the arrow to bring the figure 12 to the place previously occupied by the FIG. 5. As can be seen, all the figures remain legible in the same direction, owing to the arrangement explained in more detail hereinafter with reference to FIGS. 4, 5 and 6.

Figure 4:
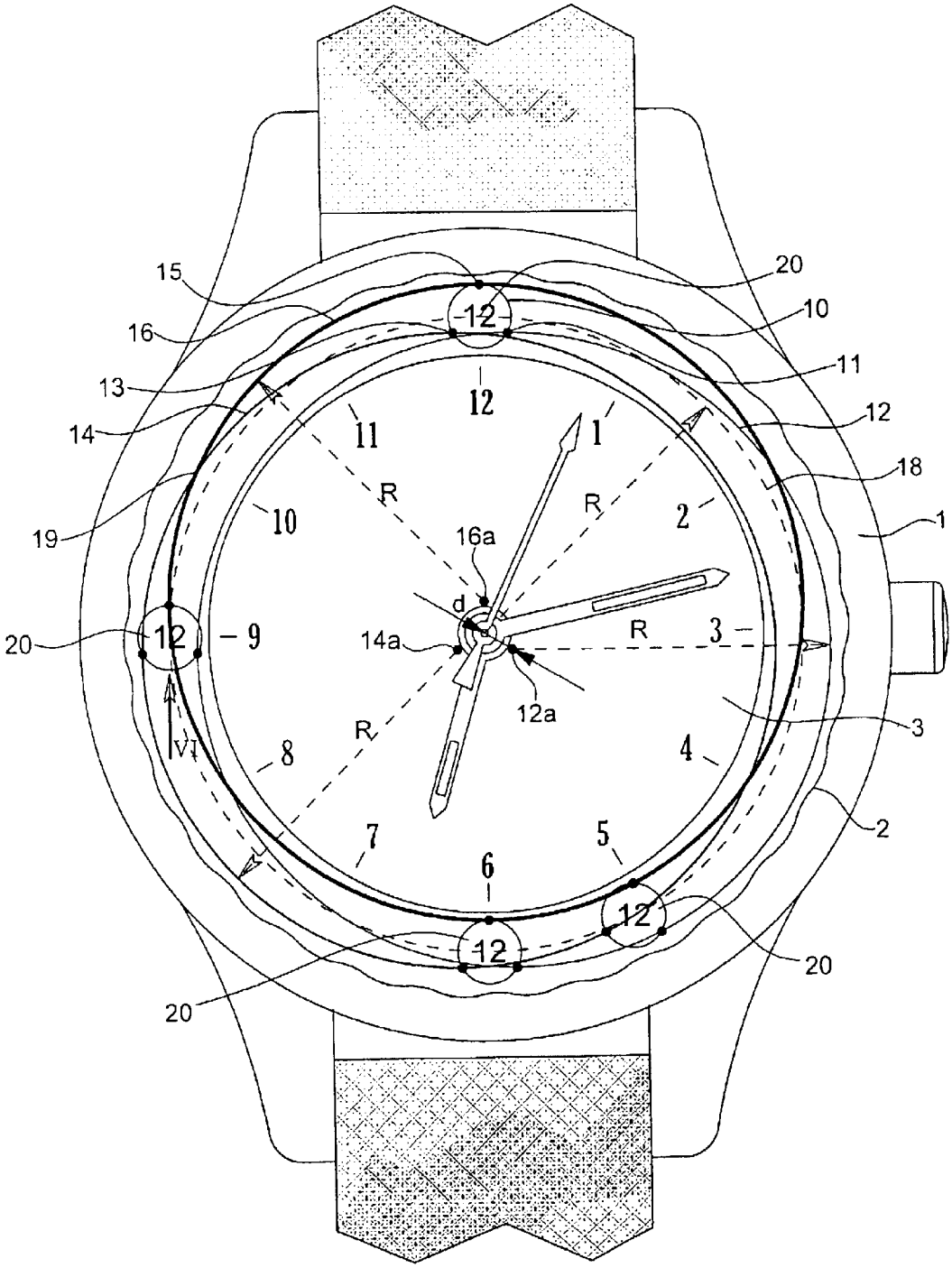
FIG. 4 shows the mechanism of the rotating bezel according to the invention.
Figure 5:
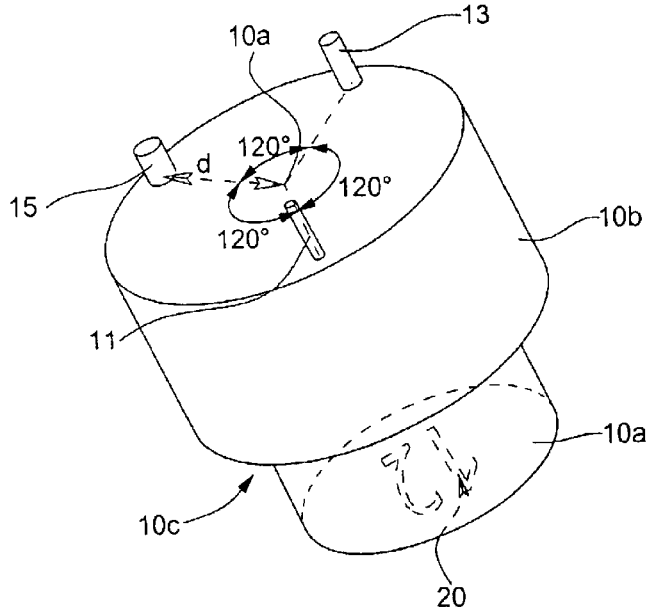
FIG. 5 is a perspective diagram, seen from below, of a stud of the rotating bezel.
Figure 6:
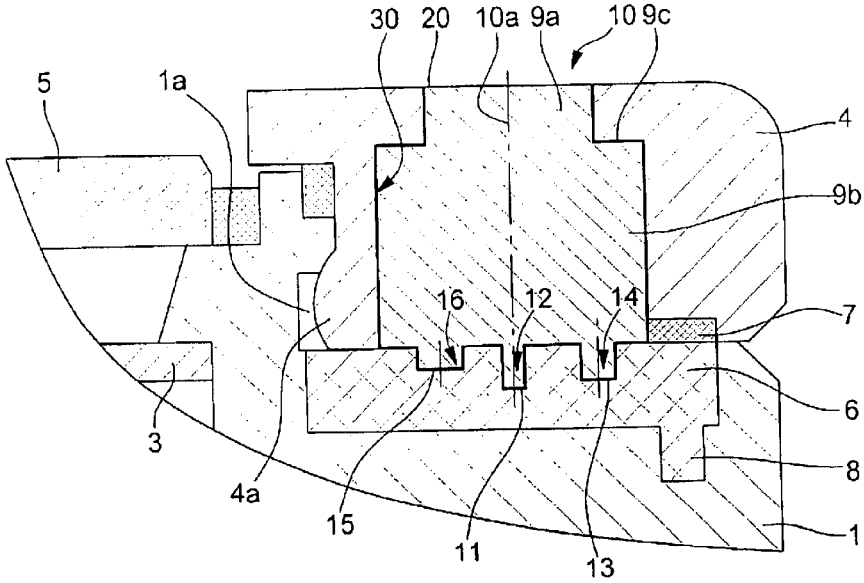
FIG. 6 is a side diagram along the arrow VI of FIG. 4.

FIG. 4 shows, on a larger scale, the wristwatch of FIG. 3 wherein it has been assumed that ring 4 of bezel 2 is transparent, and only one indication 20 corresponding to the figure 12 has been shown in four positions at 12 o'clock, 9 o'clock, 6 o'clock and 5 o'clock. With reference also to FIG. 6, in which all the constituent elements are also assumed to be transparent, it can be seen that the indications are carried by the top part 9*a* of a stud 10 kept free in rotation about its axis 10*a* in a housing 30 arranged through the thickness of ring 4, whose opening on the side of middle part 1 is closed by a circular base 6 having at least one extension 8 allowing it to be immobilised in rotation on middle part 1. Lower part 9*b* of stud 10, which has a larger diameter, forms with top part 9*a* a shoulder 9*c* allowing stud 10 to be held in housing 30, after ring 4 has been snap fitted onto middle part 1, for example by means of a raised portion 4*a* co-operating with a groove 1*a* of the middle part. In order to control the rotation of the bezel an annular spring 7 forming a catch is preferably inserted between ring 4 and base 6 outside the path described by the lower surface of studs 10. Thus, when a rotational movement is imparted to the bezel, studs 10 are also driven and their rotational axis 10*a* describes a circle 18 of radius R. With reference also to FIG. 5, it can be seen that lower part 9*b* of studs 10 is provided with three studs 11, 13 and 15 freely engaged in annular grooves 12, 14 and 16 formed in base 6, and having the same radius R as that of circle 18 described by the axis of studs 10. Stems 11, 13 and 15 are offset with respect to the axis of revolution 10*a* of studs 10 by the same distance d, and are offset with respect to each other, in the example shown, by an angle of 120°, although other angular offsets may by selected without departing from the scope of the present invention. Another feature of the invention is that all the stems have to have different dimensions. Indeed, by increasing the number of stems, and thus the number of guide grooves, a new difficulty is created, in that the centres 12*a*, 14*a* and 16*a* of grooves 12, 14 and 16 are offset with respect to the centre of dial 3 in an identical configuration to that of the stems such that said grooves intersect each other again forming switches 19 (a single reference in FIG. 4 for the sake of clarity).

It has thus seemed necessary to have grooves able to guide a single type of stem either as a function of its length, or as a function of its diameter, or preferably as a function of both of these parameters. By way of example for a stud whose lower part 9*b* has a diameter of 6 mm, all the stems are offset by a distance d=2 mm, stem 11 having a diameter of 0.5 mm and a length of 1 mm, stem 13 respectively 0.75 mm and 0.75 mm, and stem 15 respectively 1 mm and 0.5 mm. Given the stresses that are nonetheless exerted on stems 11, 13 and 15, studs 10 and stems 11, 13 and 15 are preferably made entirely of metal, for example brass. Ring 4 and base 6 are, conversely, preferably made of a plastic material allowing the desired shape to be easily obtained and offering the advantage of reducing friction. If middle part 1 is also made of a plastic material, it is possible to omit base 6 and form grooves 12, 14 and 16 directly in the top surface of said middle part 1.

The invention is not limited to the embodiment that has just been described, or to a horological application. Indeed, there may be a different number of studs, for example only four studs to mark the four cardinal points in a compass-watch or six studs to mark the decompression stops in a diver's watch. Having three stems per stud corresponds to the preferred embodiment, but one could, as indicated at the beginning, have only two studs with a different angular offset to 180°, or conversely, four stems, which would not however bring any obvious advantage technically.

A rotating bezel of the type that has just been described can also be useful for any type of measuring dial, such as the dials of an aeroplane instrument panel, or those of a domestic appliance.

What is claimed is:

1. A rotating bezel allowing the same reading direction to be kept for the indications carried by a ring able to rotate freely on a base to which it is affixed to bring a selected indication opposite a determined marking of the base or of a dial, wherein the indications are marked on an outer surface of studs each kept free in rotation about their rotational axis in a housing provided through the thickness of the ring and opening onto the base, each stud including in its lower part at least two stems of different dimensions, offset by the same distance from the rotational axis of the studs, and having an angular offset of less than 180°, each stem being guided during rotation of the bezel by a circular groove formed in the base and having a cross-section adapted to the dimensions of each stem, a radius equal to that of the circle described by the rotational axis of the studs, the centres of each groove having, with respect to the centre of the dial, exactly the same arrangement as the stems with respect to the rotational axis of the studs.

2. A rotating bezel according to claim 1, wherein the stems have different lengths.

3. A rotating bezel according to claim 1, wherein the stems have different diameters.

4. A rotating bezel according to claim 1, wherein the stems have both different lengths and different diameters.

5. A rotating bezel according to claim 1, wherein each stud includes three stems.

6. A rotating bezel according to claim 5, wherein the three stems have an angular offset of 120°.

7. A rotating bezel according to claim 1, wherein the ring and the base are made of a plastic material, and the studs and the stems are made of metal.

8. A rotating bezel according to claim 1, wherein an annular spring forming a catch is further inserted between the ring and the base, outside the path described by the lower surface of the studs.

9. A timepiece wherein it includes a rotating bezel according to claim 1, atop a middle part of said timepiece.

10. A timepiece according to claim 9, wherein the base of the bezel is snap fitted onto the top surface of the middle part.

11. A timepiece according to claim 9, wherein the base of the bezel is integral with the middle part.

12. A timepiece according to claim 9, wherein the indications carried on the studs are time indications, corresponding to the figures from 1 to 12.

* * * * *